US005246135A

United States Patent [19]

Radwill

[11] Patent Number: 5,246,135

[45] Date of Patent: Sep. 21, 1993

[54] LIMITED SLACK RAILCAR CONNECTOR HAVING ELASTIC SPACE MEMBER

[75] Inventor: Robert P. Radwill, Vero Beach, Fla.

[73] Assignee: AMSTED Industries Incorporated, Chicago, Ill.

[21] Appl. No.: 687,560

[22] Filed: Apr. 19, 1991

[51] Int. Cl.[5] ..... B61G 9/00

[52] U.S. Cl. ..... 213/64; 213/62 R

[58] Field of Search ..... 213/7, 40 R, 40 S, 59, 213/61, 62 R, 64, 67 R, 67 A; 105/3, 4.1; 267/140, 153

[56] References Cited

U.S. PATENT DOCUMENTS

| | | | |
|---|---|---|---|
| 2,149,840 | 3/1939 | Christianson | 213/61 X |
| 2,318,472 | 5/1943 | Dwyer et al. | 213/59 X |
| 2,880,888 | 4/1959 | Blattner | 213/64 |
| 2,893,665 | 7/1959 | Paulsen | 267/153 X |
| 2,893,720 | 7/1959 | Bair | 267/140 |
| 3,716,146 | 2/1973 | Altherr | 213/75 R |
| 4,258,628 | 3/1981 | Altherr | 213/75 R X |
| 4,428,568 | 1/1984 | McNatt et al. | 267/140 |
| 4,456,133 | 6/1984 | Altherr et al. | 213/62 R |
| 4,531,648 | 7/1985 | Paton | 213/64 X |
| 4,549,666 | 10/1985 | Altherr et al. | 213/62 A |

FOREIGN PATENT DOCUMENTS

| | | | |
|---|---|---|---|
| 1258258 | 8/1989 | Canada | 213/61 |

*Primary Examiner*—Robert J. Oberleitner
*Assistant Examiner*—S. Joseph Morano
*Attorney, Agent, or Firm*—Edward J. Brosius; F. S. Gregorczyk; Thomas J. Schab

[57] ABSTRACT

A railcar connector assembly includes an elastic pad held in a cage that is interposed between parts of the assembly to provide limited slack of an amount approximately equal to a dimension that the pad extends from the cage.

9 Claims, 3 Drawing Sheets

LIMITED SLACK RAILCAR CONNECTOR HAVING ELASTIC SPACE MEMBER

BACKGROUND OF THE INVENTION

This invention relates to an improved railcar connector assembly and more particularly to a freight railcar drawbar assembly and an elastic spacer therefore.

Railcar connections are made of steel and must be able to withstand large buff (retarding) and draft (pulling) loads yet be able to angle horizontally and vertically and to twist at the car sill interconnection so as to permit adjacent cars to negotiate turns and inclines and to rock transversely. In some special applications, such as coal carrying railcars, the connectors between sucessive cars must permit rotation of a car about its longitudinal axis for dumping its load. Furthermore, upon buff and draft impacts, the connections should essentially absorb movement due to longitudinal slack (the spacing between parts), such as by a cushioning draft gear, or be substantially slack free. In freight rail car connectors a popular slack free arrangement incorporates a wedge that is gradually inserted between connector and car sill parts to compensate for initial spacing and for wear that occurs during operation. Usually the wedge is located between a follower block and a sill pocket wall. Examples of slack free wedge type connections are described in U.S. Pat. Nos. 3,716,146; 4,258,628; 4,456,133 and 4,549,666.

A problem with some railcar connections is that the connector parts are maintained so tight as to bind and hinder angling and twisting of the connector even when under draft loading especially in a new condition. This is particularly troublesome between adjacent parts that are manufactured with multiple or complex curves on bearing surfaces or where the centers of curvature of the bearing surfaces do not precisely coincide. Drawbar connectors present such problems; and slack free connectors employing wedges are particularly subject to this problem when the connector undergoes maximum draft loading and the wedge efficiently moves between parts. Rotary connectors employing gravity fed wedges also present a problem that the wedge may become withdrawn or cocked when it is temporarily inverted.

Therefore, it would be advantageous to allow limited slack to occur between connector parts generally, and particularly with respect to wedged connectors where limited slack occurs without compensatory movement of the wedge. A prior attempt to accomplish this in a wedged slack free connector is described in U.S. Pat. No. 4,258,628 wherein two vertical elastomer strips are seated in vertical grooves at each side of a wedge contacting face of a follower block in an articulated rail car connection. However, the amount of elastomer that may be utilized in such an arrangement is relatively small resulting in low resistance and chase to wedge movement; and the dual arrangement of resilient strips may cause undesirable angling of the wedge under certain conditions when the connector is angled horizontally under draft load. Moreover, this arrangement, upon failure of either one of the elastomer strips, may require replacement of a follower block that has become beneficially honed to the shape of a connector butt end through usage.

Cushioning draft gear may ameliorate the problems in some connectors, such as couplers where commonly used. However, draft gear is relatively expensive and heavy; and, accordingly, it would be advantageous to provide for limited slack and elimination of the draft gear.

SUMMARY OF THE INVENTION

Accordingly, it is a principal object of the present invention to provide an improved limited slack railcar connector assembly having a single centrally disposed resilient member.

Another object of the present invention is to provide an improved limited slack freight car drawbar assembly having a resilient member disposed along the longitudinal axis of the assembly.

Yet another object of the present invention is to provide an improved wedged and substantially slack-free, freight car connection having a resilient member disposed along the longitudinal axis of the assembly so as to permit limited slack sufficient to facilitate angling of the connection.

A further object of the present invention is to provide an improved resilient member that is locatable along the longitudinal axis of a railcar connector assembly which member is separate from other parts of the assembly.

Basically, the present invention includes a single resilient pad of an elastomeric material held within a larger congruent opening of a spacer cage that is insertable between two abutting parts of a connector assembly, and functions to maintain a limited amount of slack in the assembly by resiliently applying a degree of compression between the assembly parts during draft loading on the connector.

BRIEF DESCRIPTION OF THE DRAWINGS

Further objects and advantages of the present invention will become apparent upon reading the following detailed description in conjunction with the drawings wherein.

DETAILED DESCRIPTION OF A PREFERRED EMBODIMENT

Figure 1:
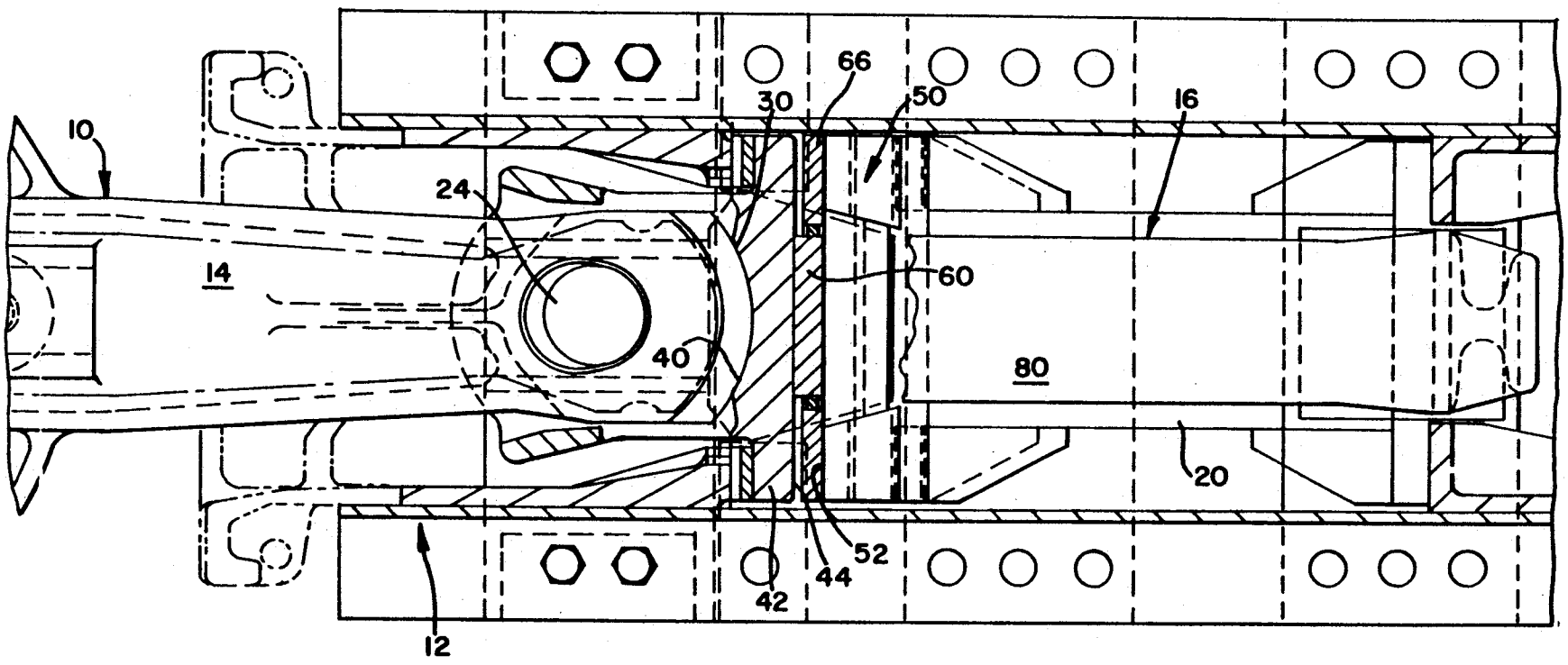
FIG. 1 is a plan view in partial section of a preferred drawbar embodiment of the present invention.
Figure 2:
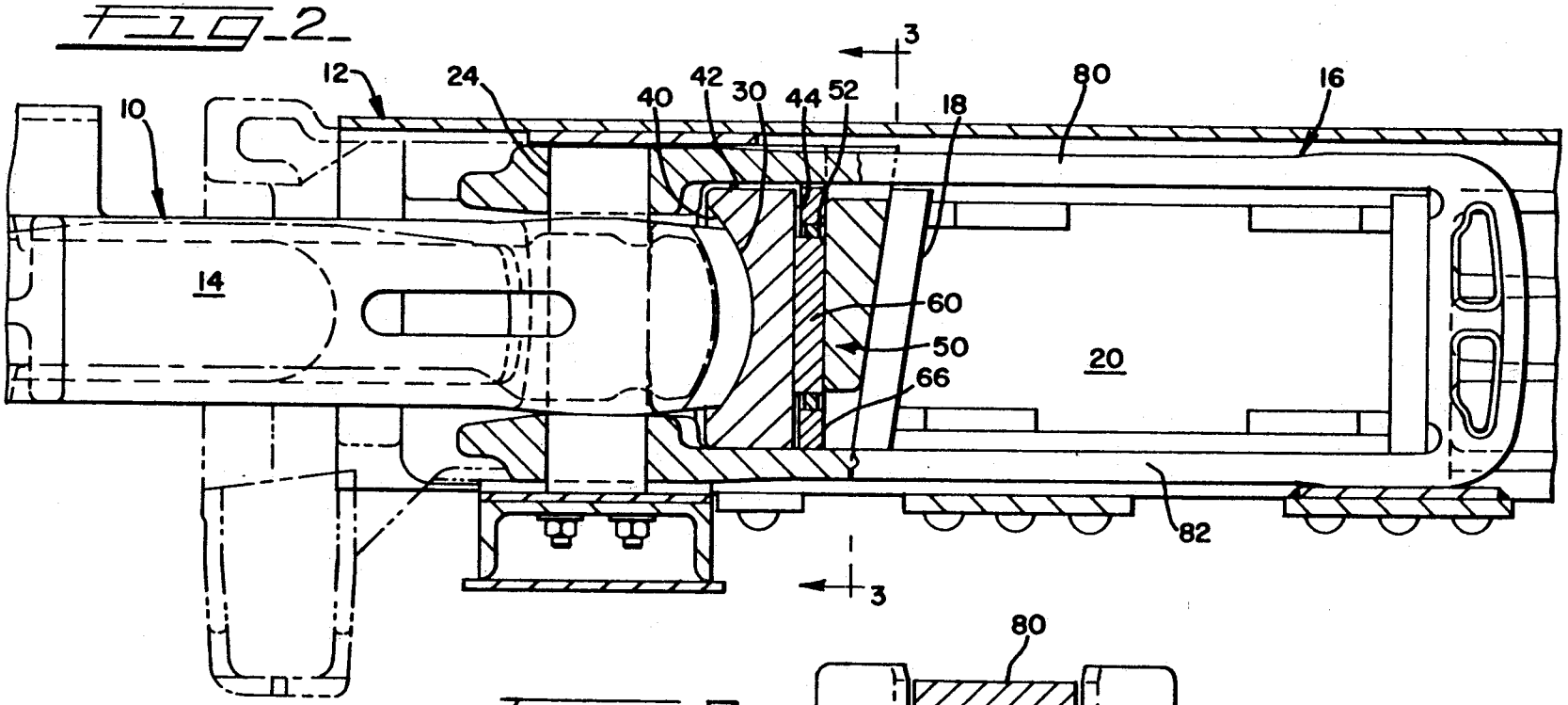
FIG. 2 is a side elevation view in partial section of the embodiment of FIG. 1.

Railcar connector assemblies usually comprise a male connector member generally 10 that is received in, and projects outwardly from, a car sill generally 12. While there are several forms of connectors to which the present invention pertains, such as articulated connectors, couplers (including E and F types) and drawbars (including rotary drawbars) to which the invention may be applied, the illustrated preferred embodiment of the present invention is in the form of a drawbar 14 that is received in a sill pocket formed by a yoke generally 16 having a sloped forward end wall 18 buttressed by an incompressible filler 20 (such as a steel tube). The drawbar 14 is of standard construction, pivotable both horizontally and vertically on a vertical pin 24 held at the forward end of the yoke 16, and has a curved butt end 30 that is received against a similarly curved bearing surface 40 of a follower block 42. The follower block 42 has a flat rear face 44 spaced from the end wall 18 by a gravity wedge generally 50 and a resilient means of the present invention.

In prior wedged drawbar assemblies the wedge is in direct abutting relation to both the follower block and the end wall. Similarly in prior coupler construction a follower block may abut a pocket end wall or draft gear. However, according to the present invention a resilient means comprising an elastic pad 60 having flat parallel faces 62 of a selected surface area "A" is positioned between the rear face 44 of the bearing block 42 and the next adjacent connector part such as the forward face 52 of wedge 50 illustrated in the FIGURES. It is important that the center of the elastic pad 60 be approximately centered on the longitudinal axis of the connector assembly, that is the pad 60 is essentially aligned with the generation points of the curves of the follower block bearing surface 40 and the butt end 30 of the drawbar 14. In that way, the elastic pad 60 will uniformly cushion the bearing block 42 and next adjacent part such as forward face 52 of wedge 50 during virtually all angles of the drawbar 14.

Figure 3:
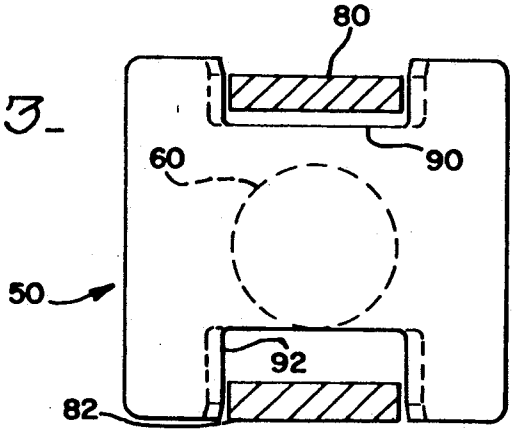
FIG. 3 is a partial section view taken at line 3—3 in FIG. 2.
Figure 4:
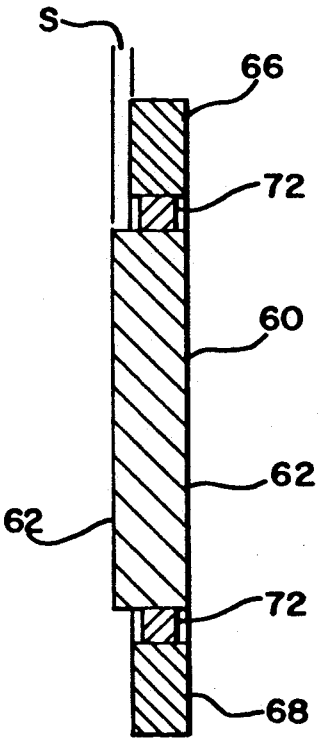
FIG. 4 is a detailed sectional side elevation view of a spacer cage and resilient pad removed from the embodiment of FIGS. 1–3.
Figure 5:
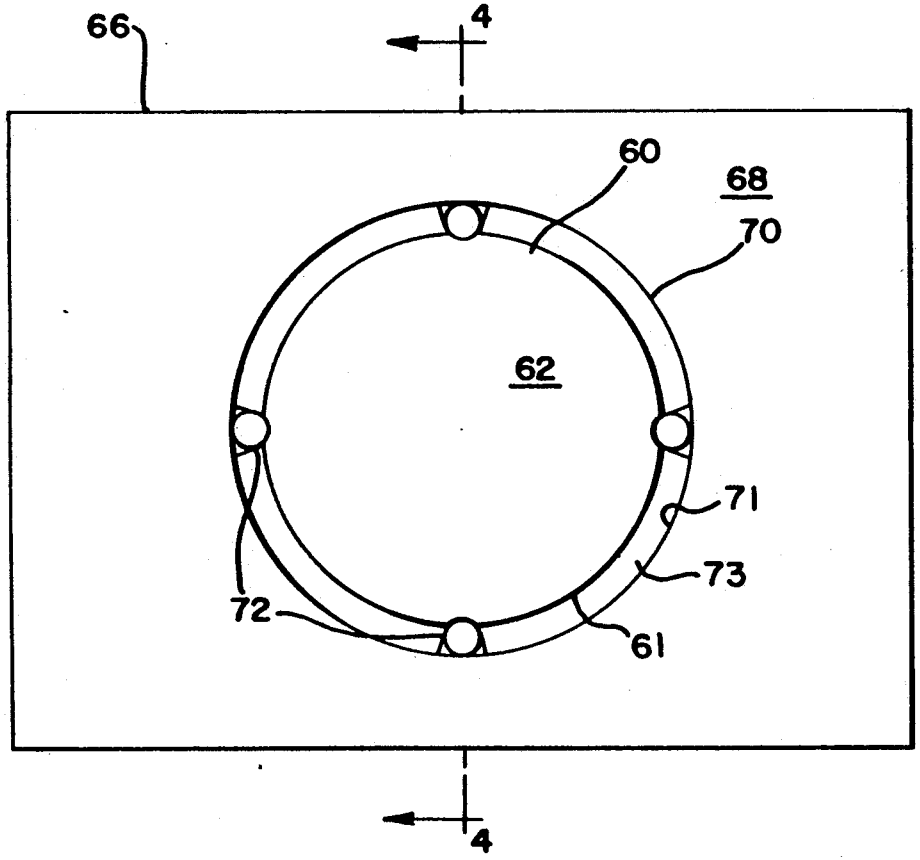
FIG. 5 is an end view of the part shown in FIG. 4.

The pad 60 is confined to the aforementioned aligned position by a spacer cage 66 which is in the form of an incompressible plate 68, preferably of steel having an opening 70 congruent with (e.g.. the same shape) but larger than the dimension of the pad 60 which is held therein by a plurality of studs 72 secured to the plate 68 and projecting into the opening 70. In FIG. 5, pad 60 has outer periphery 61 and cage opening 70 has inner periphery 71 with gap 73 therebetween. It will be understood that the cage 66 must be of a shape and dimensions to conform with the connector assembly and fit within the aforedescribed sill pocket. In the embodiment illustrated, the sill pocket is defined by the yoke 16 which has horizontal straps 80, 82 that extend across the forward end wall 18 to beyond the pin 24. Accordingly, as shown in FIG. 3, the wedge 50 has upper and lower notches 90, 92 to accommodate the respective yoke straps 80, 82; and the plate 68 of spacer cage 66 corresponds in size and shape to the follower block 42 and fits between the yoke straps 80, 82. Also in the preferred embodiment the pad 60 is a circular disk and opening 70 is circular and concentric; however it will be understood that other congruent shapes, such as square, diamond and star, may be functional.

It will also be noted that the thickness of the pad 60 slightly exceeds the thickness of the plate 68 by a dimension "S". The difference in thickness "S" is the amount of limited slack designed into the illustrated portion of the connector assembly, that is in one male to female connection. Preferably, one pad face 62 is coplanar with a surface of plate 68. Also it is preferred that the volume of space provided between the peripheral edge of the pad 60 and the congruent wall of the plate opening 70 will equal or slightly exceed the proportionate volume of the pad 60 represented by the difference in thickness "S" multiplied by the area of its face 62 ($S \times A$). Otherwise stated the volume of the opening 70 is at least equal to the volume of the pad 60. In that way when the connector assembly is fully compressed under buff loading the maximum volume displacement of the elastic pad 60 will be fully contained within the plate opening 70 and the elastomer will not become overstressed and permanently deformed. Thus when the loading on the connector assembly cycles from buff to draft the pad 60 will resume its original shape and thickness and thereby constantly exert pressure against the wedge 50, preventing further wedge insertion, until wear induced spacing exceeds the dimension "S". Yet at all times under draft load conditions, the elastic pad 60 will permit limited rearward movement of the follower block 42 caused by angling of the drawbar 14.

For rotary wedged connectors it will be understood that the aforementioned elastic pad 60 will constantly exert sufficient pressure between the connector parts to maintain their relative positions when inverted and when the connector butt rotates against a follower block.

The foregoing details have been provided to describe a best mode of the invention and further variations and modifications may be made without departing from the spirit and scope of the invention which is defined in the following claims.

What is claimed is:

1. In a railcar connector assembly having a longitudinal axis, a pocket with a pocket end wall, which pocket is forward of said end wall, a drawbar, a follower block and a wedge, which drawbar, follower block and wedge are positioned and operable in said pocket between said end wall and drawbar, the improvement comprising:

an elastic spacer member having a generally incompressible cage, said cage defining a generally central through-opening with an inner periphery and having a first face and an opposite second face;

an elastic pad with an outer periphery, said pad positionable in said central through-opening, said through-opening inner periphery and pad outer periphery defining a gap therebetween, said pad extending from said through-opening beyond at least one of said cage first and second faces;

means for fastening said elastic pad to said cage, said fastening means generally positioned in said gap and connected between said cage inner periphery and pad outer periphery to secure said pad in said through-opening;

said cage and pad positionable in said pocket between said follower block and said wedge;

said pad and follower block being substantially longitudinally aligned, which pad is operable to maintain a limited amount of slack in said connector assembly.

2. In a railway connector assembly improvement as claimed in claim 1, said pad having a center substantially aligned with the longitudinal axis of said assembly.

3. In a railway connector assembly improvement as claimed in claim 1 wherein said elastic pad has a pad center and said follower block includes a block center generally aligned with said elastic pad center.

4. An elastic spacer member for use in combination with a railcar connector assembly, said spacer member comprising:

an incompressible cage of a size and shape to fit between two adjacent parts of a railcar connector assembly, said cage having at least one surface;

said cage defining a through-opening with an inner periphery;

an elastic pad with an outer periphery;

said through-opening inner periphery and pad outer periphery defining a gap therebetween, means for fastening said pad in said through-opening, said fastening means generally positioned in said gap and extending between said cage inner periphery and said pad outer periphery to secure said pad in said through-opening, which pad extends beyond at least one surface of said cage.

5. An elastic spacer member as claimed in claim 4 wherein said cage is a rectangular metal plate defining said through-opening, which through-opening is generally centered in said plate;

said elastic pad having a shape congruent with but smaller than said through-opening.

6. An elastic spacer member as claimed in claim 5 wherein said plate defines said through-opening with a first volume in said plate; said pad having a second volume, which second volume is less than or equal to said first volume.

7. An elastic spacer member as claimed in claim 5 wherein said elastic pad is a circular disk.

8. An elastic spacer member as claimed in claim 4 wherein said means for fastening is a plurality of studs fastened between said pad outer periphery and said cage inner periphery.

9. An elastic spacer member as claimed in claim 4 wherein said pad has a first pad face and a second pad face;

said plate having a first plate face and a second plate face, one of said first and second pad faces being coplanar with one of said first and second plate faces, and the other of said first and second pad faces extending beyond the other of said first and second plate faces.

* * * * *